US005395607A

United States Patent [19]

Toshima et al.

[11] Patent Number: 5,395,607

[45] Date of Patent: Mar. 7, 1995

[54] HIGH COMPRESSIVE STRENGTH PITCH BASED CARBON FIBER

[75] Inventors: Hiroshi Toshima; Tsutomu Naito; Takashi Hino; Kazuyuki Murakami, all of Saitama, Japan

[73] Assignee: Tonen Corporation, Tokyo, Japan

[21] Appl. No.: 82,691

[22] Filed: Jun. 25, 1993

[30] Foreign Application Priority Data

Jun. 30, 1992 [JP] Japan ..... 4-196399

[51] Int. Cl.[6] ..... D01F 9/12

[52] U.S. Cl. ..... 423/447.2

[58] Field of Search ..... 423/447.2

[56] References Cited

U.S. PATENT DOCUMENTS

| | | | |
|---|---|---|---|
| 4,600,572 | 7/1986 | Hiramatsu et al. | 423/447.2 |
| 4,775,589 | 10/1988 | Hamada et al. | 423/447.2 |
| 4,898,723 | 2/1990 | Suto et al. | 423/447.2 |

FOREIGN PATENT DOCUMENTS

| | | | |
|---|---|---|---|
| 0123451 | 10/1983 | European Pat. Off. . | |
| 0355622 | 10/1989 | European Pat. Off. . | |
| 2818528 | 10/1979 | Germany . | |
| 1-124629 | 5/1989 | Japan | 423/447.2 |

OTHER PUBLICATIONS

Database WPIL, No. 93-131 575, Derwent Publications Ltd. and Japanese Publication No. 05-071 018 Mar. 1993.

Database WPIL, No. 92-354 244, Derwent Publications Ltd. and Japanese Publication No. 04-257 321. Sep. 1992.

*Primary Examiner*—Michael Lewis
*Assistant Examiner*—Stuart L. Hendrickson
*Attorney, Agent, or Firm*—Seidel, Gonda, Lavorgna & Monaco

[57] ABSTRACT

The pitch based carbon fiber has a uniform crystal structure in which substantially all crystal fibriles constituting the fiber have the thickness ranging from 30 to 200% of the average thickness Lav. Uniform stress distribution over uniform crystal fibriles can be obtained. This permits suppresion of non-linearity of the compressive modulus of elasticity of carbon fiber to greatly improve the compressive strength thereof. Typically, a compressive strength of 100 to 170 kg/mm$^2$ can be obtained with a tensile modulus of elasticity of 50 ton/mm$^2$. Such carbon fiber can be obtained by securing uniformity of molecular weight distribution of the liquid crystal pitch and also uniformity of the orientation of the liquid crystal constituent molecules by the application of multi-stage high shear spinning.

6 Claims, 2 Drawing Sheets

HIGH COMPRESSIVE STRENGTH PITCH BASED CARBON FIBER

BACKGROUND OF THE INVENTION

1. Field of the Invention

This invention relates to a pitch based carbon fiber and, more particularly, to a high compressive strength pitch based carbon fiber having a uniform crystal structure.

2. Prior Art

Heretofore, PAN and Rayon based carbon fibers made of polyacrylonitrile and rayon, respectively, are finding extensive applications as carbon fibers having high tensile strength and high tensile modulus elasticity, for instance. However, the precursors of these fibers are expensive and are inferior in the carbonization yield. Therefore, it suffers economical problems. Also, it is very difficult to produce high elastic modulus products with a tensile elastic modulus of 60 ton/mm$^2$ or above from the PAN or Rayon based carbon fibers noted above.

Recently, extensive researches and developments concerning carbon fibers obtainable from petroleum or coal tar pitches are being conducted from the standpoint of the facts that the raw materials are inexpensive and permit higher carbonization yield to be obtained. It is known that in order to obtain high strength, high elastic modulus carbon fibers, for instance, from petroleum or coal tar pitches or other carbonaceous materials, it is necessary to obtain a liquid crystal pitch with an optically anisotropic phase content of 95% or above, substantially 100%.

As examples, Japanese Patent Laid-Open No. 54-55625 shows a method of obtaining a liquid crystal pitch with an optically anisotropic phase content of substantially 100% through the long thermal pyrolysis, polymerization and/or condensation reactions by combining bubbling with inert gas and stirring, and Japanese Patent Laid-Open No. 54-160427 shows a method of obtaining a liquid crystal pitch with an optically anisotropic phase content of substantially 100% in a solvent extraction process.

Also, Japanese Patent Publication No. 61-38755 shows a method of obtaining a liquid crystal pitch with substantially 100% optically anisotropic phase content by heat treating the precursor pitch to produce an optically anisotropic phase-containing pitch and then subjecting the optically anisotropic phase-containing pitch to specific gravity difference separation. The obtainable liquid crystal pitch with substantially 100% optically anisotropic phase content has a softening point of 230° to 320° C., which is very low compared to those liqiud crystal pitches for pitch based carbon fibers disclosed in the above-mentioned Jpanese Patent Laid-Open Nos. 54-55625 and 54-160427, and thus it can be stably spun at a temperature of from 280° to 380° C.

The liquid crystal pitch obtained in this way is melt spun at a temperature of 280° to 380° C. to obtain pitch fibers, which are then oxidatively stabilized at 200° to 350° C. and then carbonaized and graphitized at a high temperature of around 500° to 3,000° C. in an inert gas atmosphere to obtain carbon fibers. If necessary, an elongation treatment is carried out simultaneously with the stabilization and carbonization processes.

The pitch based carbon fibers which are obtained in the above way, have been improved in the orientation of the constituent molecules of the liquid crystal pitch.

Thus, a high degree of the axial orientation of the molecules isattainable. Further, it is possible to obtain promotion of the graphitization and increase of the crystal size owing to the polymerization and condensation reactions of methyl and naphthenic groups in the liquid crystal pitch caused by the high temperature carbonaization. Such pitch based carbon fibers show not only higher tensile strength and modulus but higher thermal and electric conductivities.

While the pitch based carbon fibers provide higher tensile strength and especially tensile modulus caused by their higher graphitizabity, they have a significant problem that their compressive strength is extremely reduced with improvement of the crystallization degree. With current pitch based carbon fibers, the compressive strength is as low as 66 to 83 kg/mm$^2$ with a tensile elastic modulus of 50 ton/mm$^2$ and 58 to 66 kg/mm$^2$ with a tensile elastic modulus of 70 ton/mm$^2$.

With recent progress of technology, high performance carbon fibers, which are not only light in weight and highly strong at tension but also highly strong at compression, and which are nevertheless low in cost, are demanded for composite materials in the fields of space, aircrafts, vehicles, construction and various other industrial fields.

The inventors conducted extensive researches and experiments with an aim of obtaining carbon fibers, which can meet such demands, particularly those having high tensile elastic modulus and high compressive strength. As a result, it was found that crystal fibriles constituting carbon fibers have non-uniform crystal structure distribution over a crystal thickness range of 15 to 300%, sometimes 10 to 400%, of the average thickness Lav., thus leading to non-uniform stress concentration at compression. The compressive strength, therefore, was low.

Thus, if the crystal fibriles constituting carbon fibers have thicknesses held within a narrow range with respect to the average thickness Lav. and thus have high uniformity of crystal structure, it is possible to obtain uniform compressive strength distribution over each crystal fibril to obtain high compressive strength.

The inventors found that the uniformity of carbon fiber fibriles depends on the uniformity of the molecular weight distribution of the precursor liquid crystal pitch and also on the uniformity of the orientation of pitch constituent molecules promoted by the application of multiple stage high shear spinning, and also that the compressive strength of pitch based carbon fibers can be improved not only through the control of the temperature of heat treatment of the pitch fibers but also the molecular weight distribution of the liquid crystal pitch and the process of spinning of the pitch fibers.

SUMMARY OF THE INVENTION

The present invention is predicated on the above findings. According to the invention, by obtaining uniformity of the molecular weight distribution of the liquid crystal pitch and also uniformity of the orientation of the pitch constituent molecules along the fiber axis with multiple stage high shear spinning, uniform crystal structure of carbon fibers can be attained to realize carbon fibers having high compressive strength and nevertheless having high tensile elastic modulus.

An object of the invention thus is to provide a pitch based carbon fiber of high elastic modulus and high compressive strength, which has greatly improved compressive strength over the prior art pitch based carbon fiber while maintaining high tensile elastic modulus.

The above object of the invention is attained by a high compressive strength pitch based carbon fiber, which has a uniform crystal structure distribution with substantially all the crystal fibriles constituting the carbon fiber having thicknesses ranging from 30 to 200% of the average thickness Lav.

Preferably, the thickness of substantially all the crystal fibriles constituting the carbon fiber ranges from 50 to 180% of their average thickness Lav. Further, the individual crystal fibriles constituting the carbon fiber have thickness fluctuation range within ±20%, preferably ±15%, of the average and also have uniformity in the axial direction. The above high compressive strength pitch based carbon fiber has a compressive strength ranging from 100 kg/mm$^2$ to 170 kg/mm$^2$ with a tensile elastic modulus of 50 ton/mm$^2$ and ranging from 85 kg/mm$^2$ to 135 kg/mm$^2$ with a tensile elastic modulus of 70 ton/mm$^2$.

DETAILED DESCRIPTION OF THE PREFERRED EMBODIMENTS

Now a high compressive strength pitch based carbon fiber of the invention will be described in detail.

As noted before, the inventors, as a result of their extensive researches and experiments with an aim of obtaining high tensile elastic modulus, high compressive strength pitch based carbon fibers, found that improved compressive strength of carbon fibers is obtainable while maintaining high tensile strength thereof through uniformalization of the crystal structures of carbon fibers by securing uniformity of the molecular weight distribution of the liquid crystal pitch and uniformity of the orientation of the pitch constituent molucules along the fiber axis through the application of multiple stage high shear spinning.

More specifically, it was found that in order to improve the compressive strength, it is effective to use the liquid crystal pitch, which has a narrow molecular weight distribution range, practically a range of 300 to 5,000, preferably 320 to 4,000, and spin the pitch while applying super-high shear of 7 to 50 kg/cm$^2$, preferably 15 to 30 kg/cm$^2$ (usual shear applied being 0.1 to 1 kg/cm$^2$), in two or more stages for increase and uniformalization of the shear acting on the pitch constituents in the fiber axis direction (i.e., nozzle shear stress).

The shear acting on the pitch in the sectional directions of the nozzle has a distribution, that is, it is highest adjacent the inner wall surface of the nozzle and reduces as one goes toward the nozzle center. Non-uniformity of applied shear in the sectional direction of nozzle leads to non-uniformity of the molecular orientation of pitch constituent molecules in the nozzle sectional direction and ultimately leads to non-uniformity of the thickness of the carbon fiber crystal fibriles in the direction of the fiber section. To prevent this non-uniformity, high shear may be applied to the pitch as the pitch passes through the nozzle. However, even this method is insufficient for obtaining uniform shear application.

To overcome this dificiency, extensive researches and investigations were conducted to find that high shear application to the narrow molecular weight distribution range pitch as noted above in multiple stages permits realization of uniform shear application, which could not be obtained by shear application during a single passage of the pitch through the nozzle. It was thus succeeded in obtaining uniformity of the molecular orientation thereof. It was found that high shear is applied in two to four stages. More than four stages of high shear application rather results in a trend of disturbing the molecular orientation. The high shear application in an adequate number of stages has an effect of realizing high degree and uniformity of the molecular orientation which are difficult to obtain with a single stage shear application.

Figure 1:
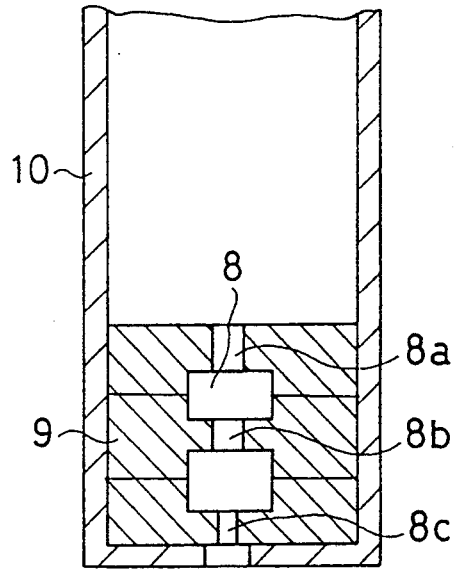
FIG. 1 is a sectional view showing a nozzle used for spinning pitch fibers for producing the carbon fibers according to the invention.

To apply high shear in multiple stages to the pitch during the passage thereof through nozzle, a liquid crystal pitch of a narrow molecular weight distribution range may be spun by using a nozzle 10 as shown in FIG. 1. The nozzle 10 has a plurality of different accommodated nozzles 9 with individual central capillaries 8*a*,8*b* and 8*c*. The high shear noted above is applied in the capillaries 8*a*, 8*b* and 8*c*. Enlarged spaces 8 between the capillaries 8*a* and 8*b* and between the capillaries 8*b* and 8*c* serve as shear alleviation spaces. Unless these spaces are provided, the spinning becomes impossible due to extreme pressure increase. Even if the spinning could be obtained, the resultant carbon fibers would have radial cracks from the surface to the core of the fiber and have inferior physical properties. If the diameter of the shear alleviation spaces is extremely large compared to the capillary diameter, the orientation produced by high shear application receives excess alleviation and is spoiled. The relation between the capillary diameter Dc and the diameter Dr of the shear alleviation spaces is suitably $Dr \leqq 5\ Dc$. Under this condition, it is possible to prevent the disability of spinning due to extreme pressure increase during the multiple stage high shear application, thus obtaining a uniformity of pitch molecule orientation in the sectional direction of the fiber that can not be obtained in the prior art.

Further, the stabilization process is suitably carried out by selecting a condition, under which it is possible to obtain more uniform oxygen uptake in the direction of the fiber section in an oxidation atmosphere (for instance, as slow heating rate as 4° C./min. or below in air). The more uniform the oxygen distribution in the fibers obtained in the stabilization process, the more uniform crystal structure in the fiber section and fiber axis direction is obtainable after carbonization or graphitization, and it is the more readily possible to obtain uniform crystal structure carbon fibers with fiber crystal fibriles thereof having thicknesses ranging from 30 to 200% of the average thickness Lav.

The carbon fibers with uniform crystal structure obtainable by the application of the multiple stage high shear spinning are excellent not only in the uniformity of crystal fibril thickness distribution but also in the thickness uniformity of the individual crystal fibriles in the fiber axis direction.

As for the liquid crystal pitch, it is important to use the pitch of a narrow molecular weight distribution range with a practical molecular weight distribution range of 300 to 5,000, preferably 320 to 4,000, while having an optically anisotropic phase content of 95% or above and an average molecular weight of 1,600 or below. Besides, such liquid crystal pitch is spun with an extremely high viscosity of 800 to 15,000 poise.

The liquid crystal pitch used may be prepared from petroleum or coal tar derived pitches, or from aromatic hydrocarbons. From such precursors, the liqid crystal pitch with a practical molecular weight distribution range of 300 to 5,000 and an optically anisotropic phase content of 95% or above. is prepared by any of the various conventional methods noted above. Preferably, the liquid crystal pitch has a further narrow molecular weight distribution range of 320 to 4,000 and an optically anisotropic phase content of 98% or above, i.e., substantially 100%. If the liquid crystal pitch used has an optically anisotropic phase content below 95%, or if it has a molecular weight distribution range above 5,000, it is difficult to obtain the pitch based carbon fibers of high tensile strength and high tensile elastic modulus.

The viscosity of the liquid crystal pitch at spinning suitably ranges from 800 to 15,000 poise, preferably from 2,000 to 7,000 poise. If the viscosity is below 800 poise, the pitch can not be high shear application spun. In this case, the stacking of the liquid crystal molecules can not be suppressed, and therefore the thickness of the resultant crystal fibriles is increased to reduce the compressive strength of the obtainable carbon fibers. If the viscosity is above 15,000 poise, on the other hand, frequent filamnent breakage occurs during the spinning, thus making the spinning difficult.

As shown above, according to the invention, it is essential to use the liquid crystal pitch of the specific molecular weight distribution range and spin the pitch by the application of multiple stage high shear spinning, in which shear (i.e., shear stress in the spinning nozzle) as high as 7 to 50 kg/cm$^2$, preferably 15 to 30 kg/cm$^2$ is applied to the pitch when the pitch passes through the nozzle. If the shear is below 7 kg/cm$^2$, sufficient molecular orientation along the fiber axis can not be obtained. If the shear is above 50 kg/cm$^2$ on the other hand, frequent filament breakage occurs during spinning, thus making the spinning difficult. If the spinning could be done, radial cracks are generated from the surface to the core of the resultant carbon fibers, that is, it is impossible to obtain high performance carbon fibers.

The pitch fibers obtained in the above way, are then stabilized in an oxidation gas atmosphere at 200° to 350° C. and then carbonized in an inert gas atmosphere at 500° to 3,000° C. to obtain carbon fibers. If necessary, the pitch fibers are elongated simultaneously with the stabilization and carbonization processes.

The high compressive strength pitch based carbon fibers as above according to the invention has uniform crystal structure distribution with substantially all their constituent crystal fibriles having thicknesses ranging from 30 to 200% of the average thickness Lav. Uniform stress distribution over uniform crystals thus can be obtained to suppress non-linearity of the compressive elastic modulus and thus greatly improve the compressive strength.

The prior art carbon fibers has non-linearity of the compressive elastic modulus, i.e., increase of the compressive stress and reduction of the compressive elastic modulus, due to stress concentration on crystals stemming from lack of uniformity of the crystal structure. Therefore, the compressive strength is low.

The compressive strength of the carbon fibers according to the invention, is specifically 100 to 170 kg/mm$^2$ with a tensile elastic modulus of 50 ton/mm$^2$ and 85 to 135 kg/mm$^2$ with a tensile elastic modulus of 70 ton/mm$^2$. In comparison, with the prior art product, it is about 75 kg/mm$^2$ with a tensile elastic modulus of 50 ton/mm$^2$ and 65 kg/mm$^2$ with a tensile elastic modulus of 70 ton/mm$^2$. This means that the carbon fibers according to the invention have improved compressive strength by 30 to 120% over the prior art product.

The term "optically anisotropic phase" used in the specification may not always be used with the same meaning in scientific societies and various technical literatures. In this specification, by the term "optically anisotropic phase" is meant a pitch component, of which a bright spot can be recognized when a polished section of a pitch mass solidified in the neighborhood of room temperature is observed with a reflection polarization microscope through a Nicol's orthgonal prism by rotating the sample or the prism, that is, which is optically anisotropic. On the other hand, a component which is optically isotropic is referred to as optically isotropic phase.

Compared to the optically isotropic phase, the optically anisotropic phase has main component molecules having a chemical structure, in which polycyclic and polypcondensed aromatic rings have associated together in the form of a laminate of planes. It is thought to be in a sort of liquid crystal state at the melting temperature. Thus, when it is extruded through a thin spinning nozzle, its molecules are oriented such that their plane is parallel to the fiber axis direction. For this reason, the carbon fibers obtained from this optically anisotropic pitch have high strength and high modulus. The optically anisotropic phase is determined by observing and photographing it in the presence of a Nicol's orthogonal prism of polarization microscope and measuring the area occupation factor of the optically anisotropic part. It is thus represented by percent by volume in practice.

In the measurement of the "molecular weight distribution" of the pitch component, a portion soluble in a solvent was dissolved in chloroform solvent for measuring its molecular weight distribution by GPC (Gel Permeation Chromatography), while the insoluble portion was made soluble through a mild hydrogenation reaction using metallic lithium and ethylene diamine before the above GPC measurement.

The "shear" was determined by calculating it under the assumption of a tubular laminar flow of liquid crystal pitch through the spinning nozzle and after the following Hagen-Poiseulle's equation:

$$\tau = 32\ \mu \cdot Q / g_c \cdot \pi \cdot D^3$$

where $\tau$ is the shear (shear stress), $\mu$ is the pitch melt viscosity, Q is the rate of pitch discharge, $g_c$ is the gravitational acceleration, and D is the spinning nozzle diameter.

Figure 2:
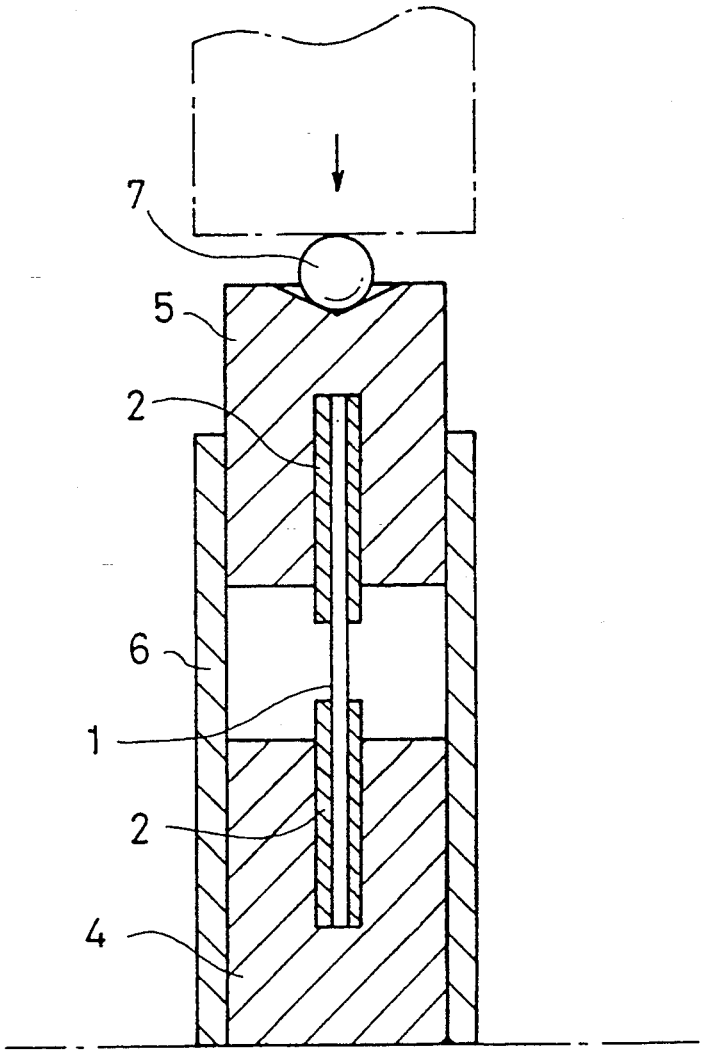
FIG. 2 is a sectional view showing a strand compressive tester used for determining the compressive strength of the carbon fibers according to the invention.

As the "compressive strength" of carbon fibers, that in the fiber axis direction was measured by a strand compressive method. FIG. 2 schematically shows a strand compressive tester used for the measurement. A strand test piece 1 with a diameter of 1 mm, which was prepared by using fibers and a resin, was fitted using epoxy resin in stainless steel tubes 2 with a diameter of 1 mm and a length of 30 mm. The assembly was then fitted in stainless steel holders 4 and 5, which were then mounted in a sleeve 6. Then, a compressive load is applied to the strand from above by the application of a point load ball 7 to determine the compressive rupture load of the strand 1 by using an equation:

$$\sigma_c = (\text{rupture load} + 0.05) \cdot \text{density} \cdot 1{,}000/\text{fineness}$$

where the rupture load is in kg, the density is in g/cc, and the fineness is in g/km.

In this equation for determining the compressive strength, 0.05 kg is added to the rupture load for the total weight of the holder 5 on the upper tube 2 and the point load application ball 7 is 50 g.

The compressive strength determined by this strand compressive method is identical with that determined in conformity to ASTM D3410 standard which are used for prior art compressive strength determination.

The average thickness Lav. of crystal fibriles of carbon fibers according to the invention were determined by observing and analyzing the dark field image with a transmitting electron microscope (TEM). In the TEM dark field image, the stacking area of the (002) lattice of graphite crystal is bright and whitish. Thus, the thickness of each whitish crystal associate, i.e., each fibril, in the photograph was measured, and the average and distribution of such thickness were determined.

Examples are given below to describe the invention in further detail.

EXAMPLE 1

A liquid crystal pitch with an optically anisotropic phase content of 100%, a softening temperature of 283° C., a molecular weight distribution range of 330 to 4,000 (referred to as liquid crystal pitch A) was used.

The accommodated nozzles 9 were inserted in the spinning nozzle 10 shown in FIG. 1, and through these nozzles the liquid crystal pitch A was spun at a temperature of 298° C. and with its viscosity of 2,000 poise by the application of two stage high shear spinning with shear of 20 kg/cm$^2$ and 10 kg/cm$^2$ in the respective first and second states, thus obtaining pitch fibers with the diameters of about 13 μm.

The pitch fibers thus obtained were then oxidatively stabilized by the heating rate of 1° C./min. from room temperature to 285° C. and then carbonized in an inert gas atmosphere at 2,000° C., thus obtaining the resultant carbon fibers.

Figure 3:
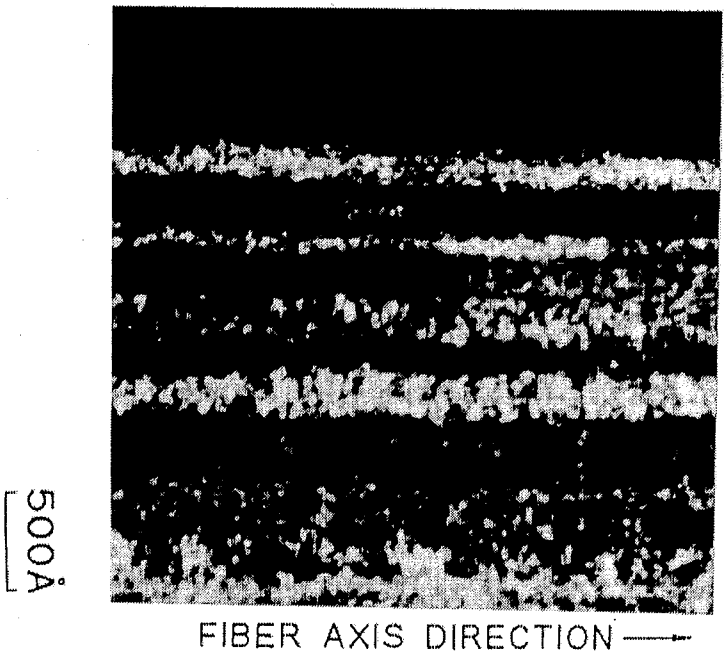
FIG. 3 is a view showing a TEM dark field image of carbon fibers obtained in Example 1 of the invention.

Table 1 below shows various physical properties of the carbon fibers thus obtained together with their crystal fibril thickness fluctuations observed with TEM, and FIG. 3 shows their TEM dark field image.

TABLE 1

| | |
|---|---|
| Fiber diameter (μm) | 9.8 |
| Tensile strength (kg/mm$^2$) | 364 |
| Tensile elastic modulus (ton/mm$^2$) | 52 |
| Tensile elongation (%) | 0.70 |
| Compressive strength (kg/mm$^2$) | 135 |
| Fibril thickness | |
| Average (Å) | 350 |
| Distribution range (Å) | 110 to 680 |
| Flucutations in fiber axis direction (%) | ±3 to ±18 (±8.3 in average) |

As is seen from Table 1, the carbon fibers according to the invention attain as high compressive strength as 135 kg/mm$^2$ with a tensile elastic modulus of 52 ton/mm$^2$. The prior art product has a compressive strength of about 75 kg/mm$_2$ with a tensile elastic modulus of 50 ton/mm$^2$, and thus according to the invention it is possible to extremely improve the compressive strength.

The average thickness Lav. of crystal fibriles obtained from FIG. 3 is 350 Å. The thickness of the fibriles is distributed in a range of 110 to 680 Å and in a range of 30 to 200% of the average thickness (i.e., in a range of 105 to 700 Å). The fibril thickness fluctuation percentage in the fiber axis direction is within ±20% and ±8.3% in the average. Thus, the crystal structure is very uniform. The fibril thickness fluctuation percentage is with respect to the average valueof one fibril.

COMPARATIVE EXAMPLE 1

The liquid crystal pitch A in Example 1 was used and spun at a temperature of 298° C. with a nozzle 0.3 mm in diameter while applying a shear of 1.2 kg/cm$^2$ in a single stage, thus obtaining pitch fibers with a diameter of about 13 μm.

The pitch fibers were then oxidatively stabilized in under the same condition as in Example 1 and then carbonized in an inert gas atmosphere at a temperature of 2,200° C. to obtain the resultant carbon fibers.

Table 2 shows the physical properties of the carbon fibers thus obtained together with the crystal fibril thickness fluctuations observed with TEM.

TABLE 2

| | |
|---|---|
| Fiber diameter (μm) | 9.7 |
| Tensile strength (kg/mm$^2$) | 302 |
| Tensile elastic modulus (ton/mm$^2$) | 51 |
| Tensile elongation (%) | 0.59 |
| Compressive strength (kg/mm$^2$) | 83 |
| Fibril thickness | |
| Average (Å) | 520 |
| Distribution range (Å) | 110 to 1,400 |
| Flucutations in fiber axis direction (%) | ±5 to ±40 (±25 in average) |

Since in this comparative example, the pitch fibers were spun by the application of single stage shear spinning, the obtained carbon fibers has a low compressive strength of 83 kg/mm$^2$ although the tensile elastic modulus is as high as 51 ton/mm$^2$ as shown in Table 2.

Further, in this case the average thickness of the crystal fibriles is 520 Å, and the fibril thickness ranges from 100 to 1,400 Å, which is a wide range exceeding the range of 30 to 200% of the average thickness (i.e., the range of 156 to 1,040 Å). Further, the fibril thickness fluctuation percentage in the fiber axis direction reaches ±40%, and the average value thereof is ±25%. That is, the crystal structure lacks uniformity.

COMPARATIVE EXAMPLE 2

A liquid crystal pitch with an optically anisotropic phase content of 100%, a softening temperature of 285° C. and a molecular weight distribution range of 300 to 10,000 (referred to as liquid crystal pitch B) was used and spun at a temperature of 295° C. by the application of two stage high shear spinning as in Example 1 with the same nozzle as therein by setting the shear to 20 and 10 kg/cm$^2$ in the respective first and second stages, thus obtaining pitch fibers with the diameters of about 13 μm.

The pitch fibers were then oxidatively stabilized in an acidic atmosphere and then sintered in an inert gas atmosphere at 2,200° C. to obtain carbon fibers.

Figure 4:
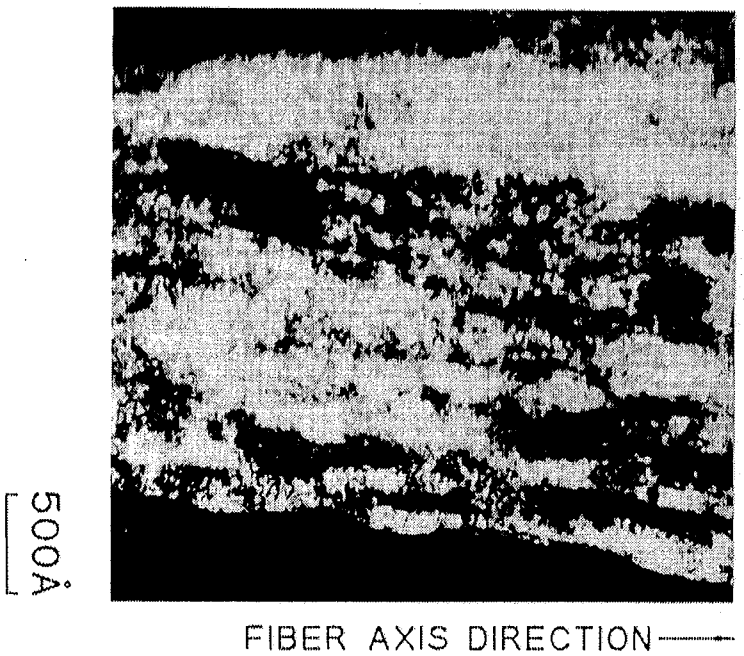
FIG. 4 is a view showing a TEM dark field image of carbon fibers obtained in Comparative Example 2.

Table 3 shows the physical properties of the carbon fibers obtained together with crystal fibril thickness fluctuations observed with TEM, and FIG. 4 shows a TEM dark field image of fibriles.

TABLE 3

| | |
|---|---|
| Fiber diameter (μm) | 9.9 |
| Tensile strength (kg/mm$^2$) | 333 |
| Tensile elastic modulus (ton/mm$^2$) | 50 |
| Tensile elongation | 0.67 |
| Compressive strength (kg/mm$^2$) | 80 |
| Fibril thickness | |
| Average (Å) | 650 |
| Distribution range (Å) | 110 to 1,800 |
| Flucutations in fiber axis direction (%) | ±8 to ±70 (±45 in average) |

While in this comparative example, the pitch fibers were spun by the application of two stage shear spinning, because the pitch of the wide molecular weight distribution range was used, the compressive strength of the obtained carbon fibers is as low as 80 kg/mm$^2$ with a tensile elastic modulus of 50 ton/mm$^2$ as shown in Table 3.

Further, in this case the average thickness Lav. of the crystal fibriles is 650 Å, and the fibril thickness ranges from 100 to 1,800 Å, which is a wide range exceeding the range of 30 to 200% of the average thickness (i.e., the range of 195 to 1,300 Å). Further, the fibril thickness fluctuation percentage in the fiber axis direction reaches ±70%, and the average value thereof is ±45%. The crystal structure is therefore extremely non-uniform.

As has been described in the foregoing, it is possible to obtain carbon fibers realizing uniform crystal structure distribution with the crystal fibriles constituting the fibers having thicknesses ranging from 30 to 200% of the average thickness Lav. by securing uniformity of the molecular weight distribution of the liquid crystal pitch and also uniformity of the orientation of the pitch constituent molecules by the application of multiple stage high shear spinning. The compressive strength of the fibers thus can be improved while ensuring high tensile elastic modulus.

What is claimed is:

1. A high compressive strength pitch based carbon fiber having a compressive strength of 85 to 170 kg/mm$^2$ and having uniform crystal structure distribution with substantially all of crystal fibrils constituting said carbon fiber having fibril thickness ranging from 30 to 200% of the average thickness.

2. A high compressive strength pitch based carbon fiber according to claim 1, wherein said crystal fibrils have fibril thickness ranging from 50 to 180% of the average thickness.

3. A high compressive strength pitch based carbon fiber according to claim 1 or 2, wherein the percentage of thickness fluctuations of each said crystal fibril in the fiber axis direction is within ±20% of the average thickness in the fiber axis direction.

4. A high compressive strength pitch based carbon fibers according to claim 3, wherein the percentage of thickness fluctuations of each said crystal fibril in the fiber axis direction is within ±15% of the average thickness in the fiber axis direction.

5. A high compressive strength pitch based carbon fiber according to claim 1, wherin the fiber has a compressive strength of 100 to 170 kg/mm$^2$ with a tensile elastic modulus of 50 ton/mm$^2$.

6. A high compressive strength pitch based carbon fiber according to claim 1, wherein the fiber has a compressive strength of 85 to 135 kg/mm$^2$ with a tensile elastic modulus of 70 ton/mm$^2$.

* * * * *